United States Patent [19]

Slagle, Jr. et al.

[11] 4,271,903

[45] Jun. 9, 1981

[54] RETRIEVABLE ANNULUS AND TUBING FLOW-CONTROL VALVES

[75] Inventors: Grady M. Slagle, Jr.; Donald O. Thomas, Jr., both of Long Beach, Calif.

[73] Assignee: Coalinga Corporation, Long Beach, Calif.

[21] Appl. No.: 29,855

[22] Filed: Apr. 13, 1979

[51] Int. Cl.[3] ..... E21B 33/128; E21B 34/10

[52] U.S. Cl. ..... 166/129; 166/183; 166/322

[58] Field of Search ..... 166/129, 183, 321, 322; 285/302

[56] References Cited

U.S. PATENT DOCUMENTS

| | | | |
|---|---|---|---|
| 2,963,089 | 12/1960 | Sizer | 166/322 X |
| 3,033,642 | 5/1962 | Page . | |
| 3,313,350 | 4/1967 | Page | 166/129 X |
| 3,958,633 | 5/1976 | Britch | 166/117.5 |
| 3,981,358 | 9/1976 | Watkins et al. | 251/79 |
| 4,031,955 | 6/1977 | Leder | 166/183 |
| 4,049,052 | 9/1977 | Arendt | 166/183 |

*Primary Examiner*—William F. Pate, III

*Attorney, Agent, or Firm*—Lyon & Lyon

[57] ABSTRACT

A flow control and safety valve for oil wells where control of flow in the casing annulus is accomplished with a wire-line retrievable device. A basic valve structure provides for control of flow in the casing annulus by means of a control line to the surface. A number of additional functions can be added to the basic valve structure to accomplish control of flow through the tubing string and can accommodate control of dual and triple zone recovery. These additional functions are accomplished by landing additional wire-line retrievable valves within the basic structure whereby independent control of the annulus and tubing string flows is possible, at the same time affording increased flow diameters for a greater volume of production in a given casing size.

2 Claims, 22 Drawing Figures

RETRIEVABLE ANNULUS AND TUBING FLOW CONTROL VALVES

BACKGROUND OF THE INVENTION

This invention relates generally to the control of fluid flow in a well and more particularly concerns the utilization of fluid pressure at the surface to independently control a valve at a subsurface location to control the flow of production fluid streams both inside and outside the tubing strings.

In the completion, production and treating of oil and gas wells, it sometimes becomes desirable to control the flow of production from more than one zone and in fact in some oil wells, it is desirable to obtain production from three separate and independent zones and it is desirable to have control over the flow from those various zones. One way of obtaining production from three zones is to utilize three independent tubing strings within one well casing. It should be obvious that insertion of three cylindrical tubing strings inside an originally cylindrical casing sacrifices a great deal of the cross-sectional area of the casing which cannot thereafter be used for production flow, and consequently, the production flow is drastically reduced. An alternative to separate tubing strings to each production zone has been the use of a combination of tubing string flow to one or two zones, using the annulus between the casing and the tubing string or strings to receive production flow from another zone. There are a number of devices utilized for the control of flow in the tubing and in the annulus. One such device is the patent of J. S. Page, Jr., U.S. Pat. No. 3,313,350 which is a tubing and annulus flow control apparatus which is wire-line retrievable. The manner in which that device functions differs materially from the present invention in that independent control of the two flow paths is not possible. In addition, because no control line to the surface is utilized therein, that device provides no safety features. Additionally, the present invention provides the user with options in the use of the device to afford him the ability to control either the casing flow or both the casing flow and the tubing string flow independently, or the casing flow and two independent tubing string flows while also providing a safety feature to each of those production zones which will automatically shut each zone in in the event there is a loss of control line pressure as the result of some damage to the control line linkage. The basic structure of the valve which provides for annulus flow control also is provided with a mechanical actuating device to open or close the valve in the event that there is damage to the control line.

SUMMARY OF THE INVENTION

In its broader aspects, the invention contemplates a combination which comprises a tubing string in an oil well, the tubing string containing apparatus for packing off between the string and the casing in the well, the packing off apparatus further including means in the tubing string for landing a wire-line retrievable valve means therein, which first valve means includes means for controlling lateral ports in the packing off apparatus to control annulus flow around the packer means. The annulus control valve is further provided with means for landing another flow control valve therein to control the flow of fluid in the tubing string. In a second form of the basic structure, there is included a structure assembled as part of the tubing string which includes the same basic packing off apparatus but further including means providing two parallel tubing strings to be situated therein. One of the tubing strings includes the means for landing a casing annulus control valve means operative to control lateral ports in the packing off apparatus to control casing flow from below to above the packing off means. Again as before, the annulus control means further includes means for landing a tubing string control valve therein. The second or parallel tubing string in the second embodiment of the invention may also include means for landing tubing string control means therein.

It is an object therefore of the present invention to provide improved flow control apparatus for an oil well which permits independent control of production flow from more than one zone while at the same time maximizing the flow control cross section thereby permitting a greater volume of production from a given casing size.

It is a further advantage and object of the present invention to provide improved flow control means in an oil well, controlling both annulus flow and one or more tubing string production flows, each independently of the other, while also affording the operator the ability to remove one or all of the control devices by wire-line retrieval when necessary for reworking or repair of the well.

It is further an object of the present invention to provide independent control of production flow from more than one zone in an oil well wherein the control of production flow is controlled from the surface by means of hydraulic control lines; said control lines affording another advantage of the present invention and that is as a safety feature, in the event of a loss of pressure in those control lines, the flow control device of the present invention will automatically shut in the well.

These and other objections and advantages of the present invention as well as the details of illustrative embodiments thereof will be more fully understood from the following detailed description of the drawings.

BRIEF DESCRIPTION OF THE DRAWINGS

FIGS. 2 through 2*d* being portions of the apparatus divided into sections adequate to illustrate their pertinent features on a scale which is readily understandable. In order to fully comprehend the invention shown in FIGS. 2–2*d*, one may connect these five figures by starting with FIG. 2 at the top to FIG. 2*d* at the bottom.

FIG. 3 is an enlarged horizontal section taken on Line 3—3 of FIG. 2*d* illustrating details of the packer section.

DETAILED DESCRIPTION OF THE FIRST EMBODIMENT

Figure 1:
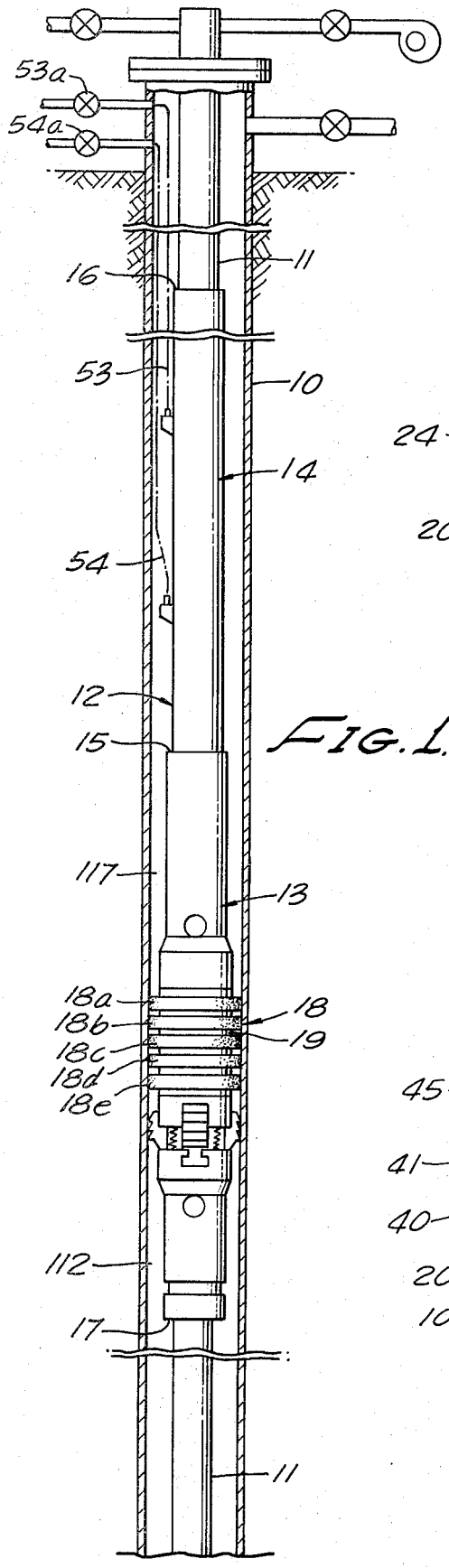
FIG. 1 is a vertical section showing the manner in which the apparatus of the present invention may be connected in combination with a string of well tubing and connected with appropriate controls at the surface.

Referring first to FIG. 1, the combination shown includes a well casing 10 and a tubing string 11 therein. The flow control apparatus generally designated 12 will been seen connected in series between two portions of the tubing string 11. The flow control apparatus 12 consists generally of two portions, the packer housing 13 and the valve housing 14 connectible in series in a tubing string as shown. Reference to the more detailed figures will reveal that the valve housing and the packer housing are threadably connected at 15 and the upper end of the valve housing is threadably connected at 16 to the tubing string and, likewise, the packer housing is threadably connected at 17 to the continuation of the tubing string.

Figure 2:
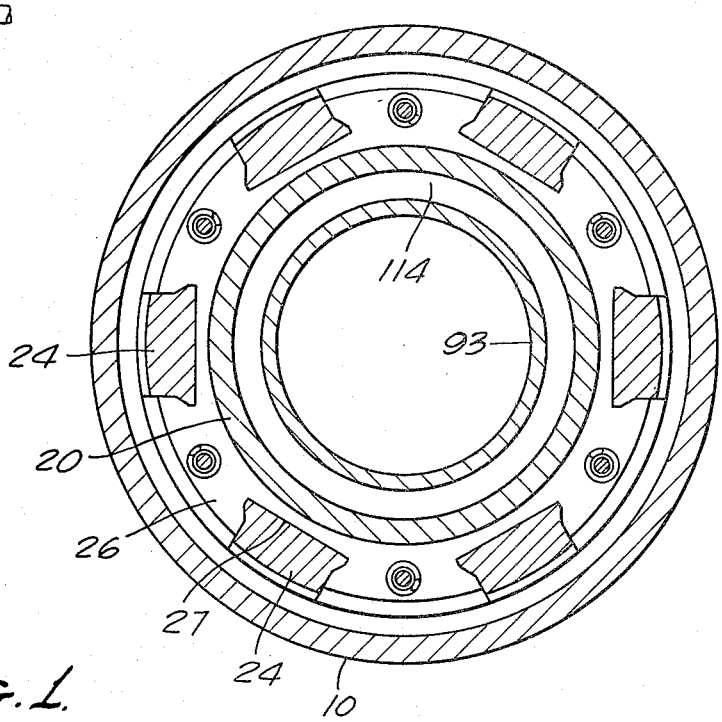
FIGS. 2, 2*a* to 2*d* are vertical half sections, for the most part, showing one embodiment of the apparatus in a well on a string of tubing.

The packer housing 13 carries what may be referred to as packer apparatus generally indicated at 18 in FIG. 1 and consisting of a number of endwise compressible ring sections 18*a*, 18*b*, 18*c*, 18*d* and 18*e* separated by metal rings 19. Reference now more specifically to FIGS. 2*c* and 2*d* discloses that the compressible ring sections are mounted on a tubular sub body 20 between a threaded shoulder ring 22 and a lower compression ring 23 which is likewise mounted upon the sub body 20. It will be apparent to those skilled in the art that the device of the present invention is situated in the well casing and held in place principally by two features of the packer assembly, including the compressible packer rings 18 as well as the slips 24. Slips 24 are typically formed to have wedge surface engagement at 25 with a cone member 26, however, cone member 26 is vertically slidable at the interface 27 with the sub body 20 in order to transmit upward thrust to the lower compression ring 23 which is operable to compress the compressible packer rings 18 as will be described below. The slips 24 have a slotted interconnection with the cone member 26 as is shown in FIG. 3. Likewise, the slips 24 have a slotted interconnection at 30 with the tubular actuator 29. Actuator 29 is slidably mounted upon the sub body 20 and is provided with a sealing member 31. As actuator 29 is situated for sliding engagement with the periphery of sub body 20, a substantial portion of its inner periphery is relieved as shown at 32 to reduce sliding friction therebetween. Actuator 29 is affixed to the lower threaded flange 33 which provides the lowermost portion of the packer housing. The interconnection between actuator 29 and ring 33 is provided by means of a shear pin 34, or actually a plurality of shear pins may be provided. Actuator 29 is further provided with a piston face 36 to which fluid pressure is transmitted from within the tubing string via the duct 37 in the sub body 20.

When sufficient fluid pressure is thus communicated to the piston face 36, shearing the pin or pins 34, the actuator 29 travels upwardly. As the actuator moves upwardly, it will maintain sealing and sliding engagement with the periphery of sub body 20 and with the lowermost actuating ring 33 by the sealing rings 31 and 31*a*. Upward travel of the slips 24 affects their outward spreading on the cone member 26 and also compression of the packer rings 18 by force transmitted to the compression ring 23 through the cone member 26 as upward force is exerted upon it by the actuator 29. As a result, the slip serrations 38 will firmly grip and anchor against the inside of the casing 10. When the device of the present invention is initially set into a well casing, actuation of the slips 24 and the compression of the packer rings 18 is initiated by the insertion of a dummy or blanking sleeve (not shown) which temporarily closes off the annulus ports 40. This blanking sleeve is also provided with a temporary plug (not shown) which cuts off flow inside the tubing string and thereby pressurizes the interior of the packer housing communicating fluid pressure through the duct 37 to actuate the actuator as described. Once the packer slips 24 are firmly engaged with the casing 10, thereby squeezing the packer rings 18 and causing them also to sealingly engage the casing wall, the full weight of the tubing string above the packer housing can be allowed to rest and push downwardly upon the slips 24 and the pressure provided to the actuator by means of the blanking sleeve can be removed so that now the weight of the tubing string itself as supported by the slips can further engage the casing wall, further compressing the packer rings 18 securely setting the packer within the well casing. Release of the slips is readily accomplished by upward withdrawal of the tool. Upward withdrawal causes sliding engagement along the wedge surface 25, compression of the rings 18 is diminished and the slips are allowed to withdraw from the casing walls so that the tubing string can be withdrawn upwardly with the packer disengaged.

Figure 4:
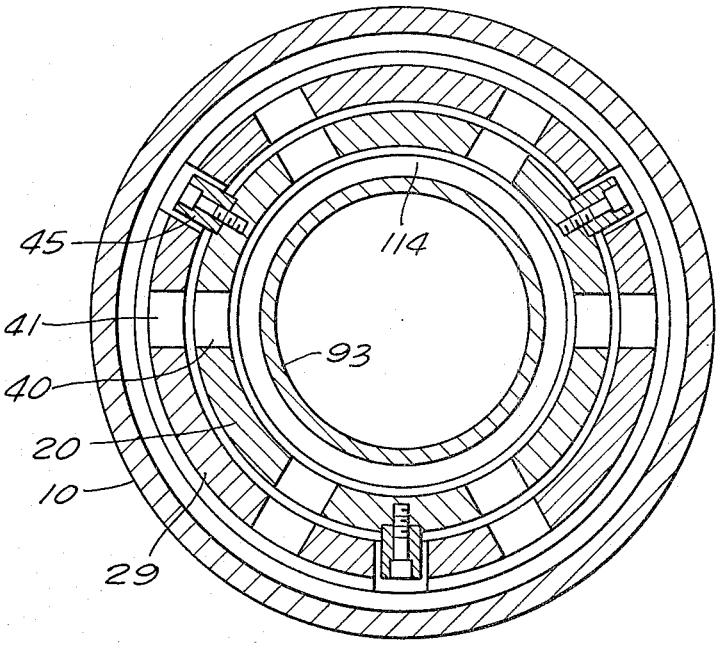
FIG. 4 is an enlarged horizontal section taken on Line 4—4 of FIG. 2*d* showing further details of the packer apparatus.

Reference to FIG. 2*d* and FIG. 4 exemplifies additional features of the packer mechanism. Intermediate the slips 24 stationed about the periphery of the sub body 20 are a plurality of compression springs 42 mounted between the upper shoulder of actuator 29 and the lower portion of the cone member 26. These compression springs 42 are provided with a spring guide 43 which resides in a passage 44 in the cone member 26. Compression springs 42 provide a slight downward biasing force on the slips 24 which will facilitate disengagement of the slips from the casing walls in the event that it is desired to disengage the packer. Of equal importance, are the guide blocks 45 affixed to the sub body 20 which limit rotational movement of the actuator 29 with respect to the sub body 20.

Referring back to FIG. 1 and FIGS. 2, 2*a* and 2*b*, it will be noted that the valve housing 14 is threadably connected to the packer housing at 15 and to the tubing string at the upper end thereof at 16. The valve housing consists primarily of a tubular member 48 having one or, in the case of this embodiment, two recessed control ducts 49 and 50. At each of the ducts 49 and 50, there is affixed a connector block 51 and 52, respectively, to which are threadably attached fluid conducting control lines 53 and 54, respectively. The interior surface of tubular body 48 at duct 49 is provided with an annular recess so that, for reasons to be made clear hereinafter, fluid pressure in control line 53 may be communicated to different portions of the periphery within the interior of tubular member 48 as communicated by duct 49. Likewise, at duct 50, an enlarged annular recess is provided in the interior of tubular body member 48 not only in this case to communicate fluid supplied by control line 54 to different points of the periphery inside of tubular body 48 but also to provide frictional relief for elements of the invention which reside inside of tubular member 48. The upper end of tubular member 48 immediately below its threaded connection 16 is provided with grooving 56 which is adapted to receive latch fingers carried by the first valve member to be hereinafter described.

The primary or first valve means to be landed in the valve housing provides the fundamental concept of the present invention. This primary valve will provide discrete control of the annulus flow via a control line to the surface, yet is wire-line retrievable, and of relatively slight diameter restriction such that maximum flow diameters are maintained, while also providing a tubing string opening of sufficient diameter to permit wo king through in many instances. The primary valve may also provide means for landing secondary valves to control tubing flow. Secondary valves may include ball, flapper or sleeve valves mounted either coaxially or parallel to the primary valve, or both.

The primary valve 60 is a sleeve valve. A conventional latch mechanism, one of several known configurations, is shown comprising the spring arms 58 which urge the fingers 61 into engagement with the grooving 56 and shoulder 57 with detent 59. Thus, the primary valve is landed in the housing 14, suspended from the spring arms 58. The spring arms are carried by a collet ring 63, threaded to a short nipple 65 and then in turn to member 66.

Member 66 is a relatively long cylindrical member extending downwardly from the vicinity of the spring arms, past the first control line connector block 51 to the vicinity of the second control line 54. In passing the duct 49, member 66 is provided with a lateral duct 67 in registry with duct 49. This is merely a pass-through duct to be utilized by the secondary or tubing string control valve to be described subsequently. Additionally, as will be described in conjunction with a variation of this embodiment of the invention, wherein the first control line or tubing string valve are both omitted from the makeup of the valve assembly, this portion of member 66 will be omitted too.

The lowermost end of member 66 is provided with annular seal means 69 and 70 and a lateral pressure equalizing duct 71 communicating the interface between the two seal means 69 and 70 and between member 66 and member 48 of the valve housing. Duct 71 communicates with an annular passage 75 which as will be seen in FIG. 2*b*, ultimately communicates with the interior of the tubing string. The lower extremity of member 66 is threadably attached to a shoulder nipple 76 which in turn is threadably attached to sleeve 78. Between the lower end of nipple 76 and shoulder 77 of sleeve 78, a snap ring 80 is retained. Situated in an annular recess of the shoulder nipple 76 is a mechanical lock sleeve 82 which is provided on the inner periphery thereof with grooving 83 which may have a design similar to the grooving 56. Snap ring 80 engages a lower recessed extremity of lock ring 82 and intermediate recess 84 on lock ring 82 provides another recess in which the snap ring 80 may be received. The function of the mechanical lock ring 82 will be explained in more detail in conjunction with the functioning of the primary valve. Suffice it to say at this point that the mechanical lock 82 provides mechanical replacement for the hydraulic fluid pressure provided in control line 54 to actuate the primary valve in those instances where hydraulic fluid pressure in control line 54 is lost for some reason.

Sleeve 78 is provided with a lateral duct 79 in approximate registry with duct 50 of control line 54. In turn, sleeve 78 is threadably attached to an intermediate nipple 87 and then to spring retainer sleeve 89. The lower extremity of sleeve 89, as seen in FIG. 2*c*, is provided with a shoulder 90.

The primary valve element consists of tubular sleeve 92 positioned within sleeve member 78 and the intermediate nipple 87 and in sliding and sealing relationship therewith. The interior periphery of sleeve member 78 and a portion of nipple 87 is provided with a vertically elongated annular recess in fluid communication with ducts 79 and 50. Shoulder 94 of valve element 92 provides a piston face which under the influence of fluid pressure in duct 79 drives the piston face 94, and therefore the entire valve element 92, downwardly to the position shown in FIG. 2*b*. In the absence of fluid pressure in duct 79, valve element 92 would be in a vertically higher position than that shown in FIG. 2*b* such that the uppermost edge 93 would be in approximately the location of shoulder 77. This describes the approximate length of travel of the valve element 92. A stop ring 95 is threadably attached to intermediate nipple 97. Stop ring 95 has an angled shoulder at its upper extremity which engages another shoulder at 96 on the valve element 92. In this manner, stop ring 95, by its vertical dimension and by the position of the interengagement of shoulders at 96, determines the limits of up and down excursions of the valve element 92. Affixed to the valve element 92 is a shoulder sleeve 97, the upper extremity of which is provided with a stop to engage the lower extremity of the stop ring 95. The lower extremity of shoulder sleeve 97 is provided with stop means to engage a compression spring 99. Compression spring 99 is retained between shoulder sleeve 97 and the shoulder 90 of spring retainer sleeve 89.

Because of the rather excessive length of this valve assembly, valve element 92 may be provided with a flex joint generally designated by the numeral 100. The valve element then continues past the flex joint 100 and this valve element designated 93 consists of a cylindrical element which terminates (FIG. 2*d*) in a sealing assembly 102. This sealing assembly 102, includes a nipple 104 threaded to the lower extremity of valve element 93, a pair of sealing rings 106 and 108 and a shoulder ring 109 threadably attached to the nipple 104. A sealing sleeve 107 is loosely positioned on the nipple 104 intermediate the sealing rings 106 and 108. Sleeve 107 serves to maintain the position of the two sealing rings 106 and 108. Sealing ring 106 is also maintained in position by an upper shoulder 110 and sealing ring 108 is maintained in position by a shoulder in the shoulder ring 109.

Equalizer ducts 91 are provided in valve element 92, placing the fluid pressure of the tubing string in communication with annular space 91*a* between valve element 92 and upper sub body 21. Fluid pressure in annular space 91*a* will act downwardly upon shoulder 101 of the flexible joint 100 to balance upward pressure exerted upon the lowermost shoulder 109*a* of the valve element 93. Additionally, fluid pressure in annulus 91*a* will equalize upward and downward pressure differentials on the spring retainer shoulder 90, and those shoulder areas in communication with annular space 75 which is similarly in fluid pressure communication with the tubing string. Suffice it to say that pressure equalization ducts and annular spaces are provided to all moving parts to equalize any pressure differentials so that such parts may move freely under the positive control of the desired forces and independent of annulus or tubing pressures.

In its downwardmost position as shown in FIG. 2*d*, the valve element 93 opens passages 40 and 41 which communicate with the annulus 112. FIG. 2*d* does not show the slips 24 engaged with the casing walls. In such a circumstance, the lateral passage 41 in actuator 29 would be shifted vertically upwardly. It will be noted that passage 41 is shown to have an enlarged size as compared to passage 40. This is to afford good fluid communication between passages 40 and 41 regardless of the position of the actuator 29. Arrow 113 exemplifies the approximate path of fluid flow from the annulus 112 through passages 40 and 41 into the interior bypass annulus 114. The upper cylindrical sub body 21 which is coupled between sub body 20 and cylindrical member 48 is provided with a lateral passage 116 in fluid communication with the bypass annulus 114 and with the casing annulus 117 situated above the packer rings 18. Arrow 118 in FIG. 2*c* shows the approximate path of fluid travel from the bypass annulus 114, through passage 116 into the upper casing annulus 117.

With the exception of fact that the slips 24 are not shown in engagement with the casing wall nor are the compression rings 18 shown expanded to seal the packing off device, it will thus be seen that in the position of the valve elements as shown in FIGS. 2*c* and 2*d*, the flow of fluid when the packing off device has been set will bypass the pack-off apparatus and casing annulus flow will exit the casing annulus, enter the bypass annulus 114 and then exit again into the casing annulus to flow on upwardly. Sealing assembly 102 will remain in its downwardmost position leaving the annulus ducts or passages open for this purpose as long as the pressure is maintained in fluid passage 79 continuing to force the piston 94 downwardly against the upper force of the compression spring 99. It will be apparent, from looking at FIG. 2*d*, that whenever the fluid pressure is decreased in passage 79 (FIG. 2*b*) permitting the force of the compression spring to move the valve element 92/93 upwardly, that the sealing assembly 102 will move upwardly therewith such that the sealing rings 106 and 108 will bracket the lateral passage 40 shutting off fluid flow therethrough.

As previously mentioned, there may be times when it is desired to actuate the valve element 92 where there is a loss or lack of sufficient fluid pressure in the control line 54. Mechanical actuation of valve element 92 may be accomplished in the absence of any secondary valve in the tubing string. If such a valve, to be described later, has been inserted inside of the primary valve, it would be necessary to retrieve it first. In any event, by appropriately landing a mechanical push-down device (not shown) in the grooving 83 of mechanical lock ring 82, it will be apparent that by pushing downwardly thereon, snap ring 80 will be dislocated from the lower recess of lock ring 82 permitting the lock ring to move downwardly until snap ring 80 falls into the upper recess 84. In traveling the distance between those two recesses, it will be seen that the mechanical lock ring 82 has moved downwardly a distance sufficient to displace the valve element 92 downwardly a distance approximately as shown in FIG. 2*b*. By appropriately engaging the grooving 83 of lock ring 82, it would be possible to mechanically shift the valve element either from an open to a closed position or from a closed position to an open position as may be necessary.

Figure 2:
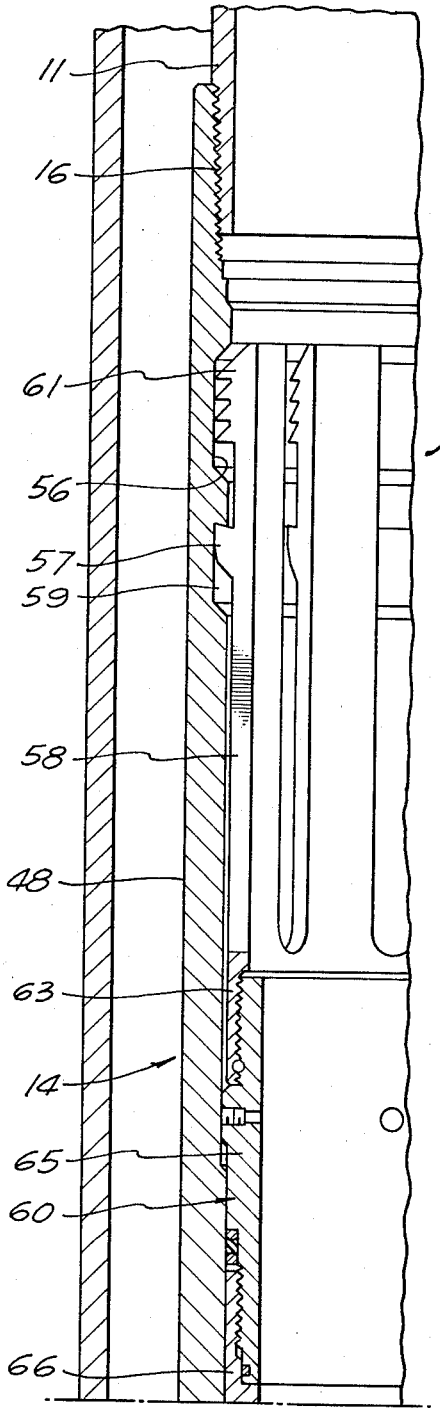
Figure 2A:
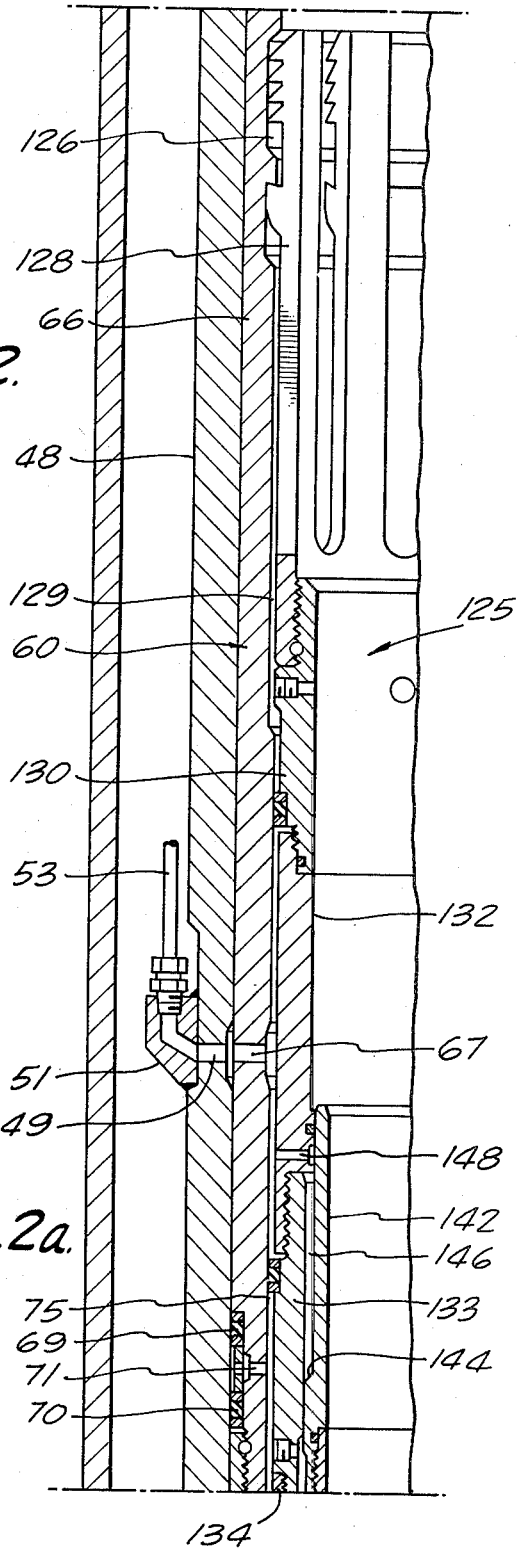
Figure 2B:
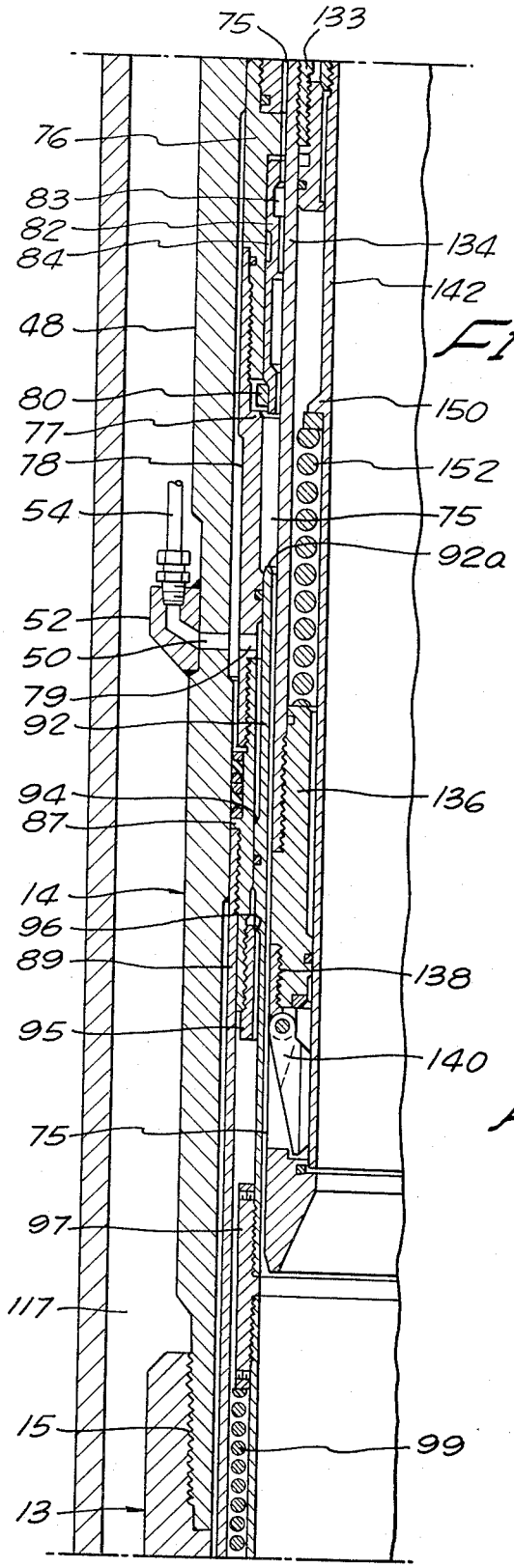
Figure 2C:
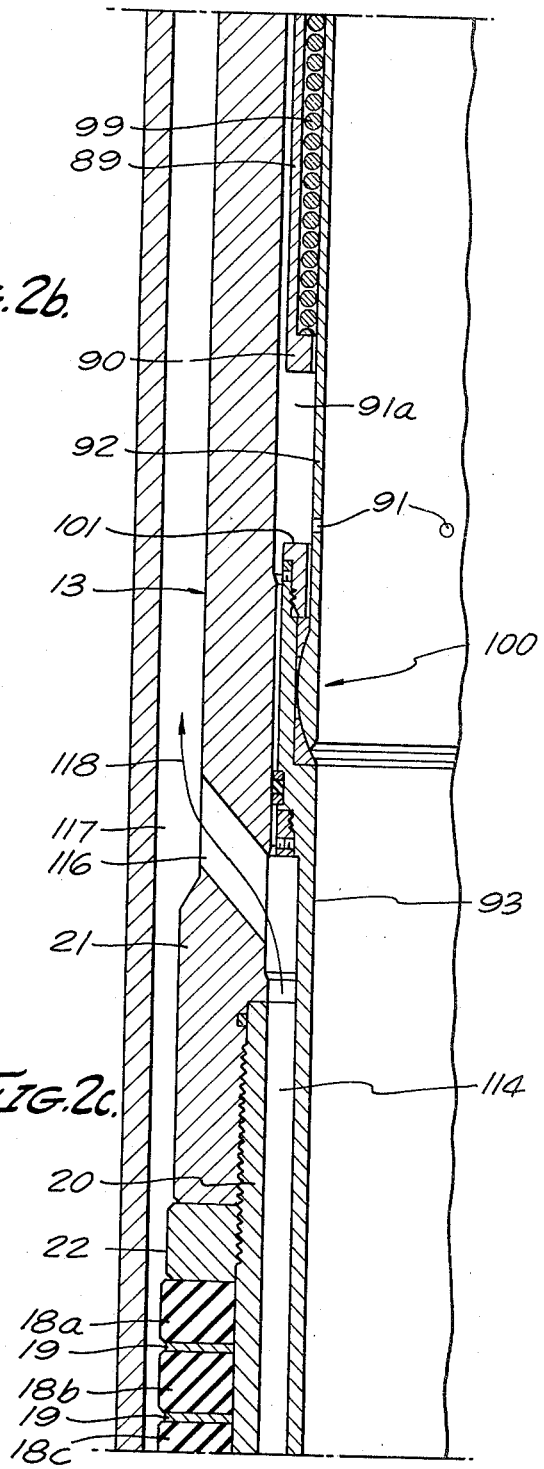
Figure 2D:
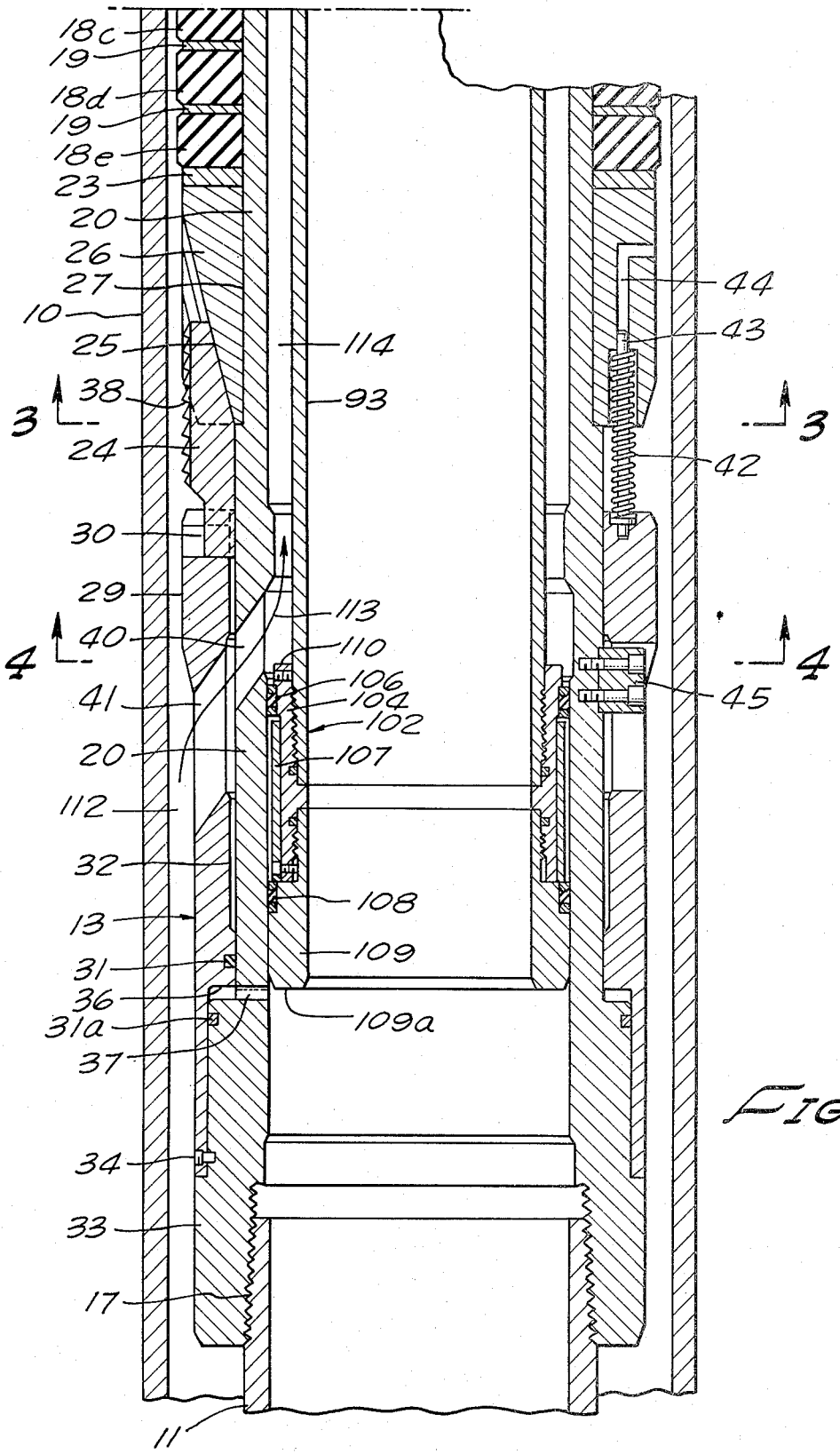

A secondary valve generally designated 125 and shown in FIGS. 2*a* and 2*b* may be landed within the primary valve 60. This may be accomplished in a manner similar to that for the primary valve in that the primary valve is provided with groovings 126 to receive spring arms 128 of the secondary valve. The spring arms 128 are connected by a collet ring 129 to an intermediate nipple 130 which in turn is connected to a sleeve member 132. The lower extremity of sleeve 132 is threadably fastened to another sleeve 134 which is in turn threadably attached to a spring retaining nipple 136. Spring retaining nipple 136 is in turn threadably attached to a valve element retaining ring 138 to which is mounted a flapper valve 140. Valve element 142 in the form of a tubular sleeve is slidably positioned within the interior of sleeves 132, 133 and 134. The lower extremity of valve element 142 extends downwardly to engage the flapper valve 140 as shown in FIG. 2*b*. In FIGS. 2*a* and 2*b*, valve element 142 is shown in its downwardmost position. Valve element 142 is provided with a shoulder 144 in annular recess 146. Shoulder 144 provides a piston face for valve element 142 which is under fluid pressure in annular recess 146 being in fluid communication with lateral passage 148 which in turn receives fluid pressure through lateral duct 67 and lateral duct 49. Thus, when fluid pressure is applied through control line 53, fluid pressure in annular recess 146 will force the valve element 142 to its downwardmost position as shown. Valve element 142 also includes a shoulder 150 which retains compression spring 152 between that shoulder 150 and the shoulder nipple 136. In the absence of sufficient fluid pressure in the control line 53 or at least on the piston face 144, compression spring 152 will cause the valve element 142 to return to its upwardmost position permitting the flapper valve element 140 to close the tubing string passage. Thus, pressure in control line 53 may be utilized to turn on or off production flow in the tubing string and may also provide a safety means to automatically shut down production flow in the tubing string in the event of damage to the control line.

Thus it will be seen by the foregoing description that this version of the first embodiment of the present invention has provided a packing assembly and a valve assembly wherein the packing assembly is made up by and forms a part of the tubing string and wherein the packing assembly when set is adapted to receive an annulus flow control valve assembly capable of bypassing annulus flow around the packer assembly and capable of independent control from the surface of the well. This embodiment further provides means for receiving a secondary flow control valve capable of controlling flow within the tubing string, and this latter assembly operates separate and independent from the primary valve by a separate control line to the surface. Both of the valve means are wire-line retrievable from the tubing string.

FIGS. 5, 5*a*, 5*b* and 5*c* exemplify an alternative arrangement to that shown in FIGS. 2, 2*a*, etc. It will be apparent from the foregoing description that in the absence of a desire to provide positive or independent control over production flow in the tubing string, the secondary valve 125 could be omitted from the combination shown in the first preferred embodiment. In such an instance, control line 53 would simply not be used unless at a still later time it was desired to add a secondary valve. Under such circumstances, by making up the combination as shown in FIG. 2, et seq., these options would be available to the operator.

Figure 5:
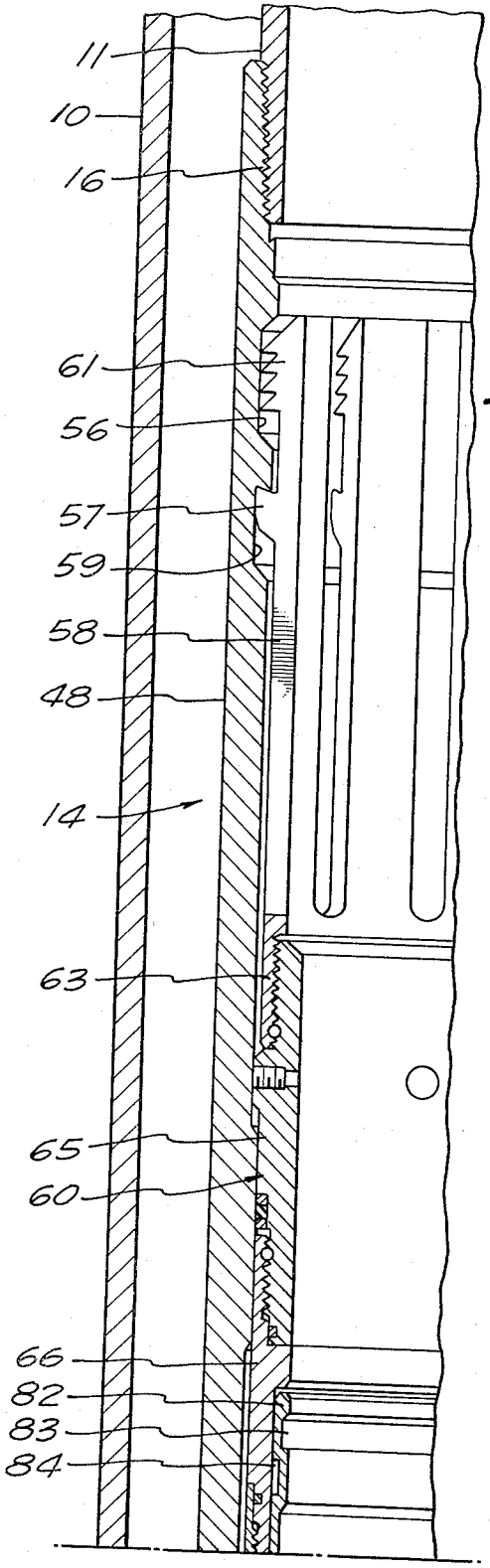
FIGS. 5 to 5*c* are vertical half sections showing a modified version of the first embodiment of the present invention, this version eliminating the second control line and the tubing control valve.
Figure 5A:
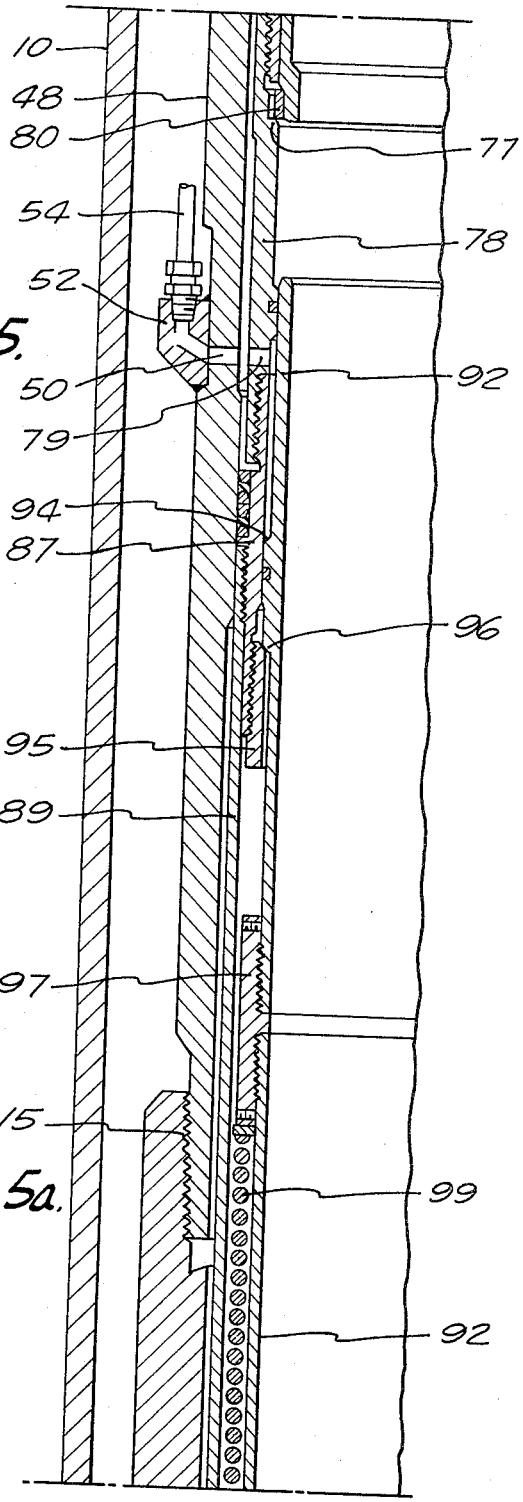
Figure 5B:
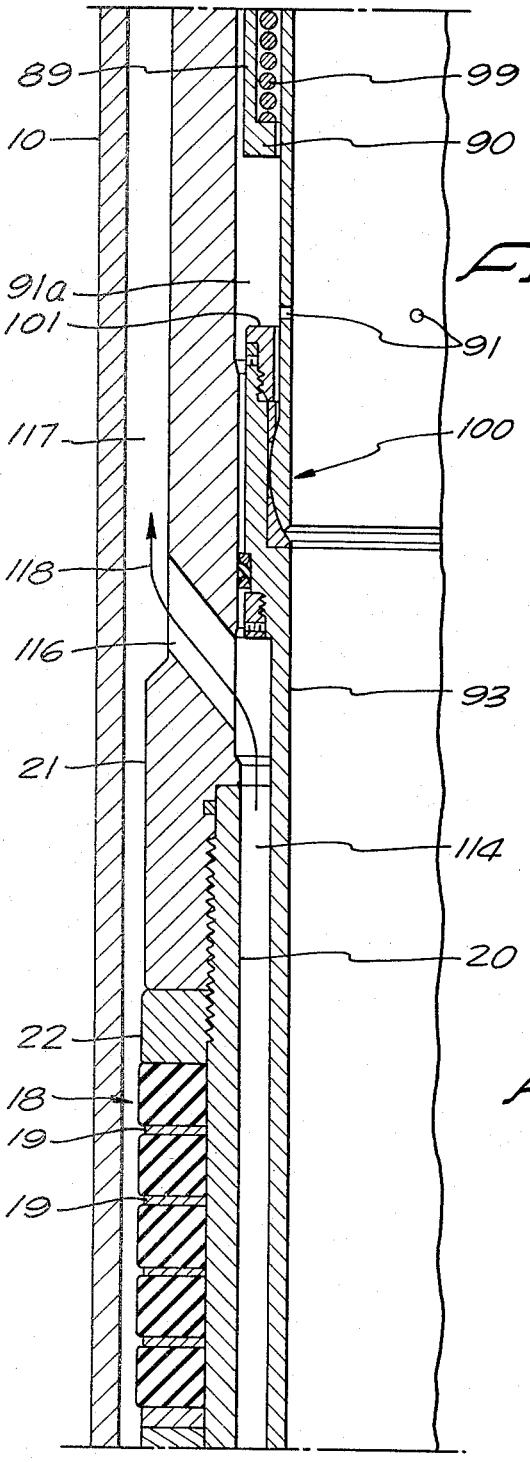
Figure 5C:
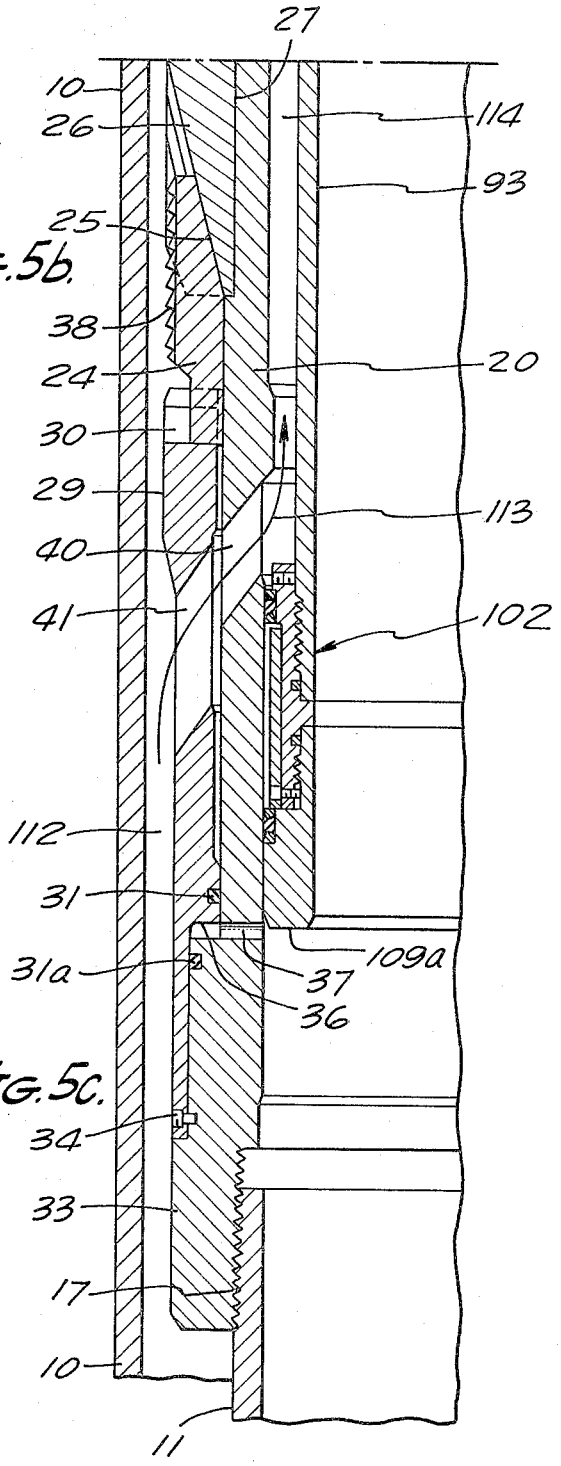

FIG. 5, et seq., exemplifies an embodiment of the invention wherein the need for control over flow in the tubing string is previously determined to be of no importance. Under such circumstances, the operator would make up the tubing string in the manner shown, for example, in FIG. 5*a* utilizing but a single control line port sleeve. Considering the foreshortening of the overall valve housing in response to the requirement for but a single control line port, it will be readily apparent from reviewing FIGS. 5, 5*a* and 5*b* that the remainder of the essential features of the first embodiment of the invention are retained. Only a few of the extension sleeves and the grooving 126 have been removed. In all other aspects, as indicated by the corresponding numerals designating like parts, the assemblies of FIGS. 2, et seq., and FIGS. 5, et seq., are quite similar.

DETAILED DESCRIPTION OF THE SECOND EMBODIMENT

The second embodiment of the present invention includes, as with the first embodiment, a packer housing and a valve housing. In the first embodiment, the valve housing included means for controlling the annulus flow to bypass the packer housing. In the second embodiment, the primary valve is also used so that means is provided for bypassing the packer under control from the surface. In addition to providing the option of including an axially mounted tubing string control valve such as secondary valve 125 as described in the first embodiment, the second embodiment adds to the packer housing a tubing string support means adapted to receive two parallel tubing strings. In the additional tubing string, it is contemplated that an operator may choose to insert landing means to receive a tubing control valve of the type described herein; thus permitting the operator to obtain separate and independent control over production flow from a third production zone utilizing annulus flow and two parallel tubing strings.

Figure 6:
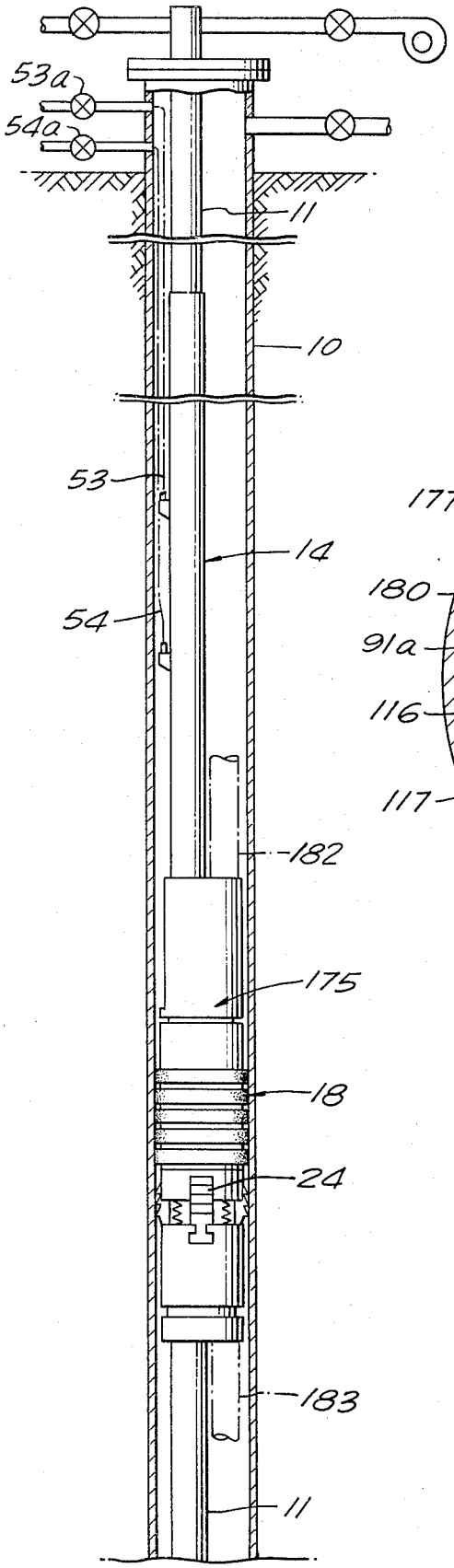
FIG. 6 is a second vertical section showing the manner in which the basic packer feature of the present invention may be modified by the connection, in combination with a string of well tubing, of a device which permits two parallel tubing strings to be controlled in conjunction with control of the annulus.

Turning now to FIG. 6, the configuration of the second embodiment of the invention is shown. Here, in an oil well casing 10, the installation consists principally of the valve housing 14 and a packer housing as before; the details of the construction and configuration of the valve housing 14 and primary valve 60 are substantially as described with respect to the configuration of FIG. 2, et seq., and no further explanation of that is deemed necessary for the purposes of understanding this embodiment. In the drawings of the structures which are FIGS. 7, 7*a*–7*c* and of the modified form of the valve structure shown in FIGS. 9, 9*a*–9*c*, like reference numberals indicate like structures. In this embodiment, it will be apparent that the dimensional differences of the structure contained within the valve housing 14 may be somewhat less in order to accommodate a smaller valve housing diameter, but other than that it is contemplated that the structure be substantially the same.

What is different about this embodiment is the addition to the packer housing of additional tubing string support means and, in FIG. 6, this is denoted by the modified form of packer housing designated generally by the numeral 175. Packer housing 175 comprises an upper dual-string body 177 and a lower dual-string body 179, the two of which are threadably attached at 178. The upper and lower bodies 177 and 179 have a cylindrical outer periphery substantially filling the casing and providing a casing annulus 117. The configuration of the upper and lower dual-string bodies 177 and 179 may best be seen by examining the horizontal cross section shown in FIG. 8, which cross section is taken along Line 8—8 of FIG. 7*b*. The upper and lower bodies are provided with aligned bores 180 and 181 through which separate tubing strings can provide production flow.

Figure 8:
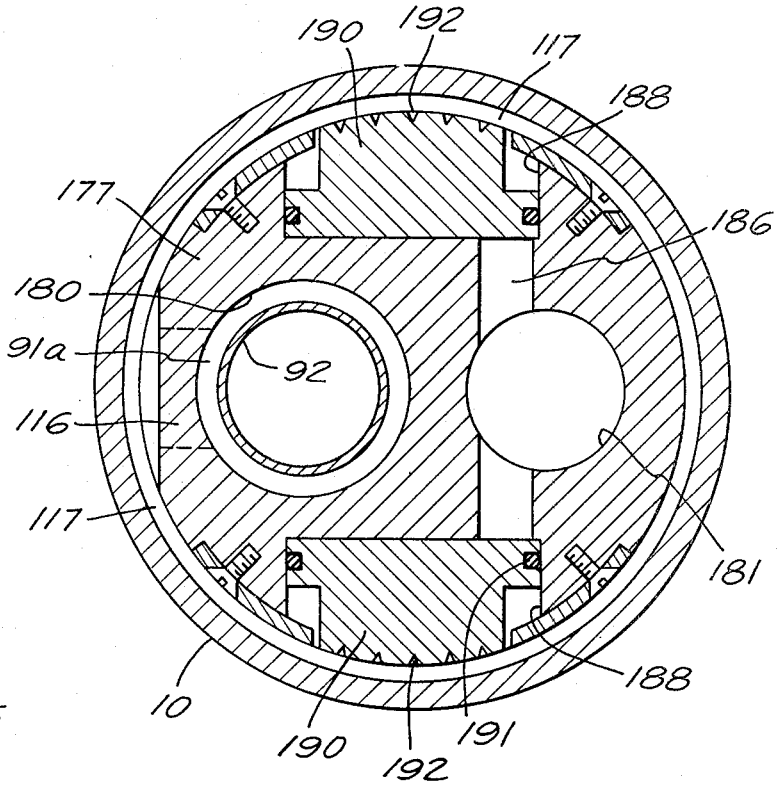
FIG. 8 is an enlarged horizontal sectional view taken along Line 8—8 of FIG. 7*b* showing some features of the parallel tubing string packer and the hold-down mechanism employed therein.

Bore 180 in body 177 receives therein the casing annulus control valve element 92 as previously described in the first embodiment. Thus, between the outer periphery of valve element 92 and the bore 180, the cross section taken at FIG. 8 demonstrates the annular space 91*a* therebetween to which by appropriate ducting through valve element 92 or 93 pressure equalization is maintained. Additionally, FIG. 8 shows that a short distance below the place where the cross section is taken the lateral passage 116 communicates annulus 117 with the interior bypass annulus 114 (see FIG. 7*b*); also in the manner described in the fast embodiment. Thus, bore 180 of the upper dual-string body 177 may receive either of the versions of the structure of the first embodiment and in any event is adapted to receive the casing annulus control valve 60 as previously described. The manner in which the casing annulus control valve is situated and functions within bore 180 is substantially as previously described. In addition, the manner in which the slips 24 are set to engage the casing wall 10 and the manner in which the slips cooperate with the cone member 26 under the influence of the actuator 29 to compress the compression rings 18 is as previously described. The upper and lower dual string bodies 177 and 179 thus provide additional tubing string support for a tubing string to be connected to bore 181. FIG. 6 shows in phantom lines for illustrative purposes the position at which an additional tubing string 182 may be connected to the body 177 to extend above the packer and a tubing string 183 may be connected thereto to extend below the packer. In the stead of a tubing string 182, it may be desirable to threadably attach at 184 a valve housing similar to valve housing 14 capable of landing a tubing control valve assembly similar to assembly 125 as previously described.

The bore 181, however, is not adapted to receive a tubing control valve therein inasmuch as tubing flow through bore 181 is utilized as will be shown with respect to FIG. 8 to achieve additional hold-down capabilities between the packer assembly housing 175 and the casing 10. For this purpose, bore 181 is provided with two lateral ducts 186 and 187. Lateral duct 186 is shown in FIG. 8. The duct 186 extends from bore 181 toward the periphery of the body 117 into a cutout section 188 in each side of the body 177. Situated in each of the bores 188 are hold-down pistons 190. Pistons 190 are provided with seal means 191 which engage the side walls of the cutouts 188 and the pistons are slidably received therein. Fluid pressure in bore 181 is communicated through the lateral passages 186 and is exerted outwardly on the hold-down pistons 190. The outer periphery of the hold-down pistons 190 are provided with serrated surfaces 192 and, when pressurized and extended from the cutouts 188, engage the casing wall 10. Retaining plates 193 are affixed to the body 177 to prevent the hold-down pistons from being extended entirely out of the cutouts 188. In use, the hold-down pistons 190 experience fluid pressure from the bore 181 and are forced outwardly to engage the casing wall 10. This additional hold-down function for these pistons augments the function of the packer. Although the packer is principally intended to support the tubing string and prevent further downward movement thereof, other than the weight of the tubing string and the lateral force of the compression rings 18, nothing holds the tubing string from blowing upwardly under the influence of high fluid pressures below the packer. Since substantial upward forces on the tubing string can result particularly where one or more of the production flow conduits may be shut down during various stages of operation, the hold-down pistons 190 function under the influence of tubing string pressure to prevent upward movement of the tubing string.

Figure 7:
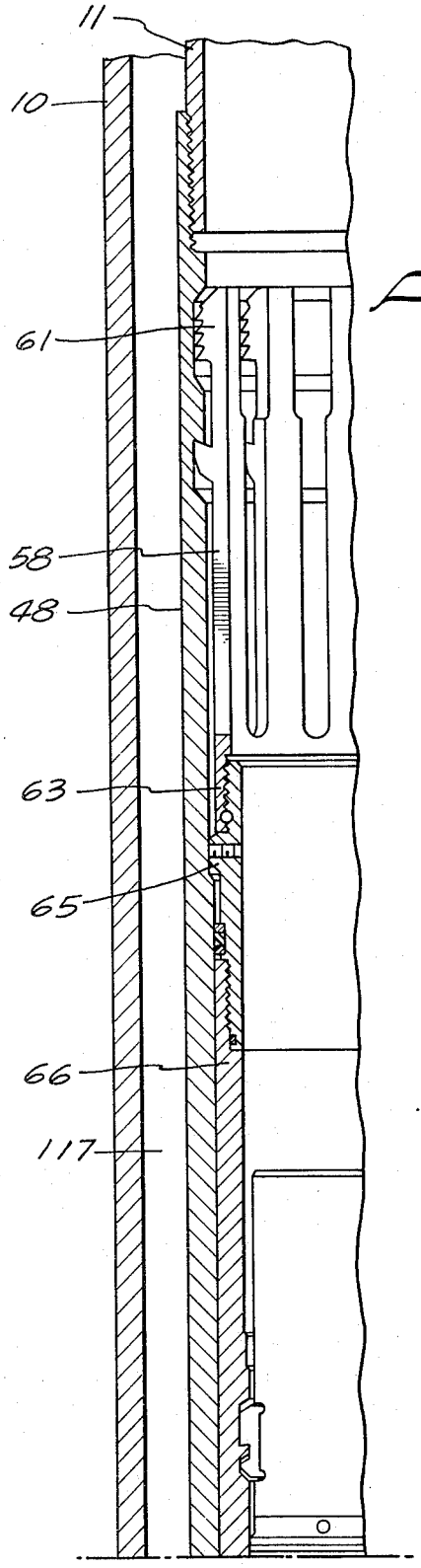
FIGS. 7 through 7*c* show the second embodiment of the present invention employing the combination of an annulus control valve and a tubing control valve similar to that shown in FIGS. 2–2*d*, but further including the ability to provide another parallel tubing string for a three-zone production system.
Figure 7A:
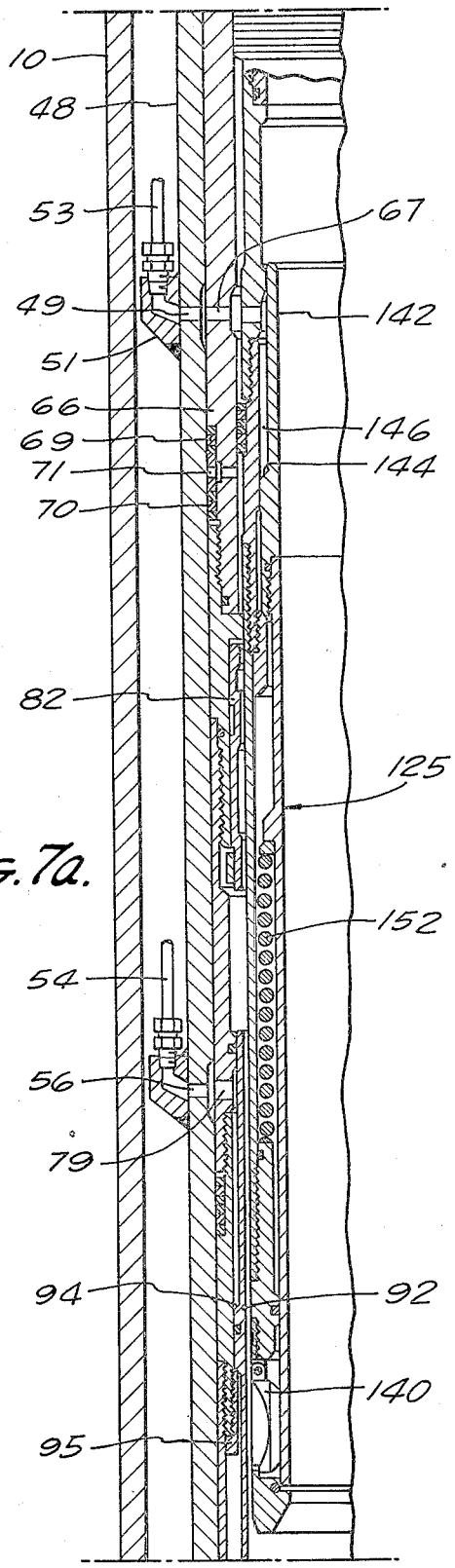
Figure 7B:
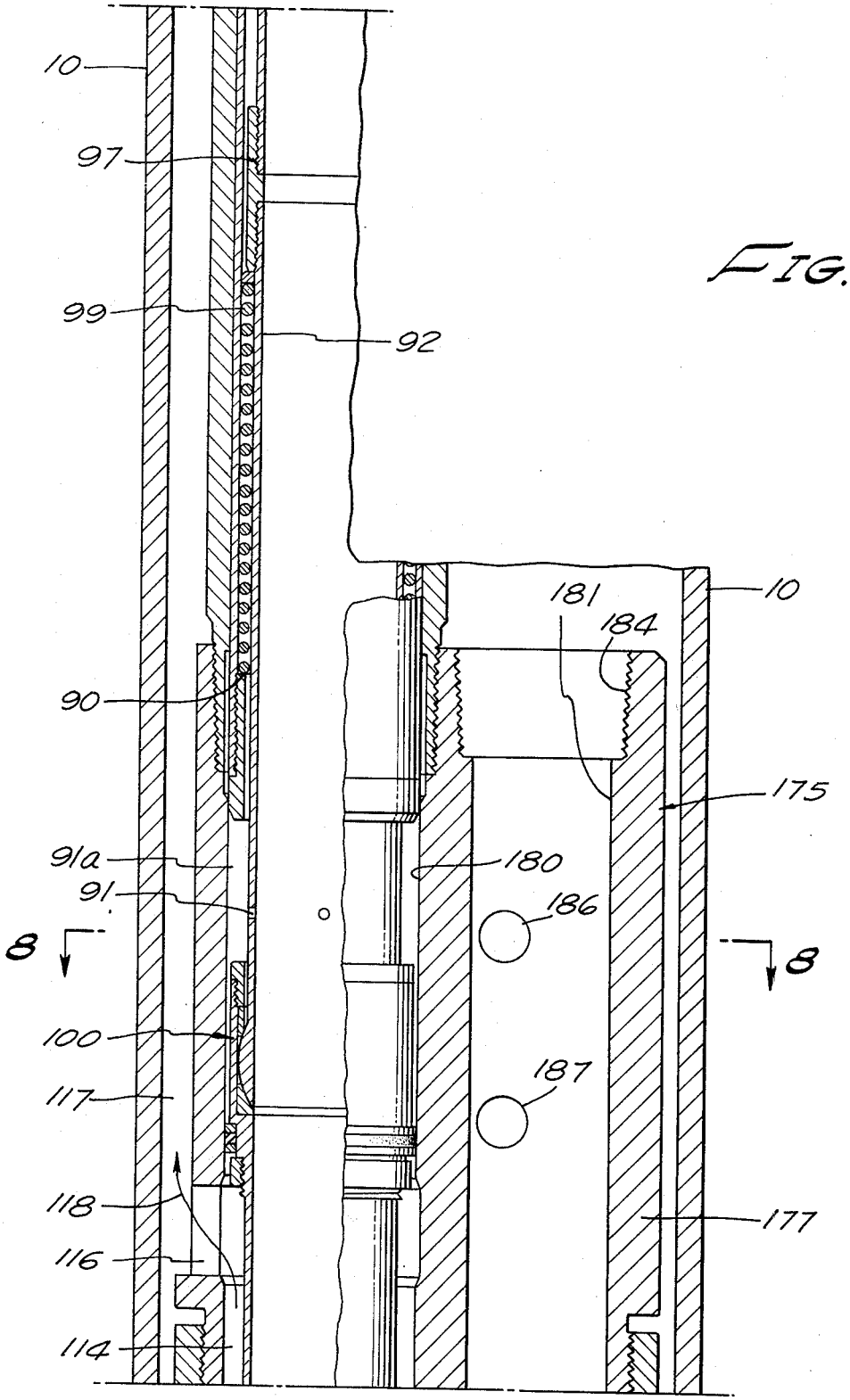
Figure 7C:
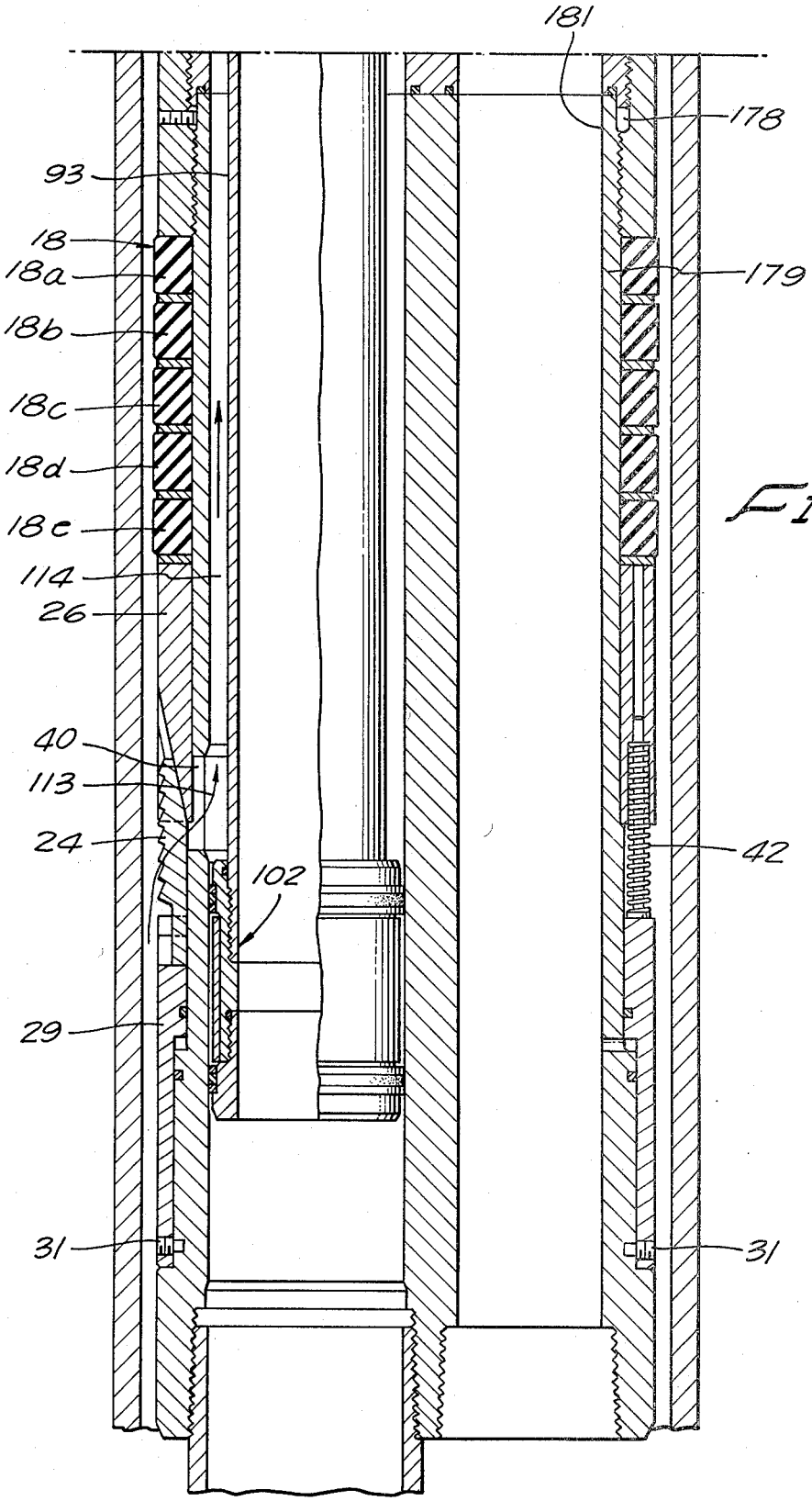
Figure 9:
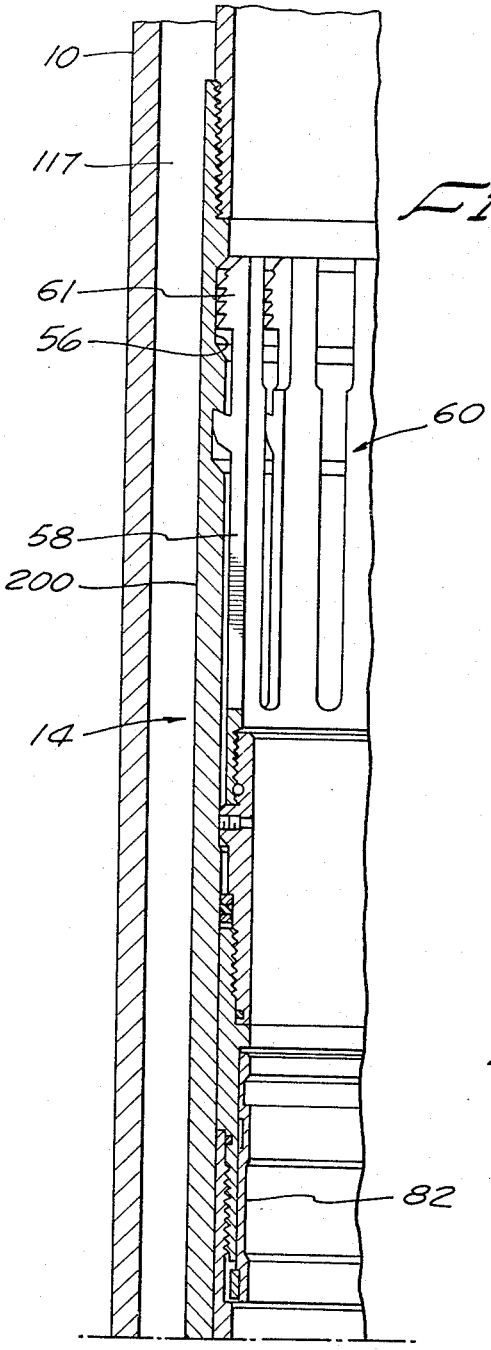
FIGS. 9 through 9*c* are vertical half sections showing a modified form of the second embodiment wherein the tubing control valve is eliminated.
Figure 9A:
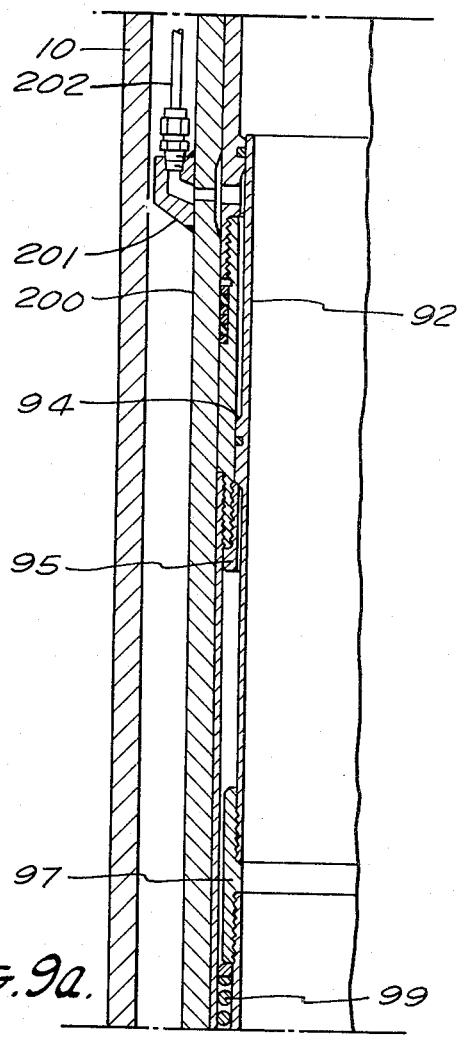
Figure 9B:
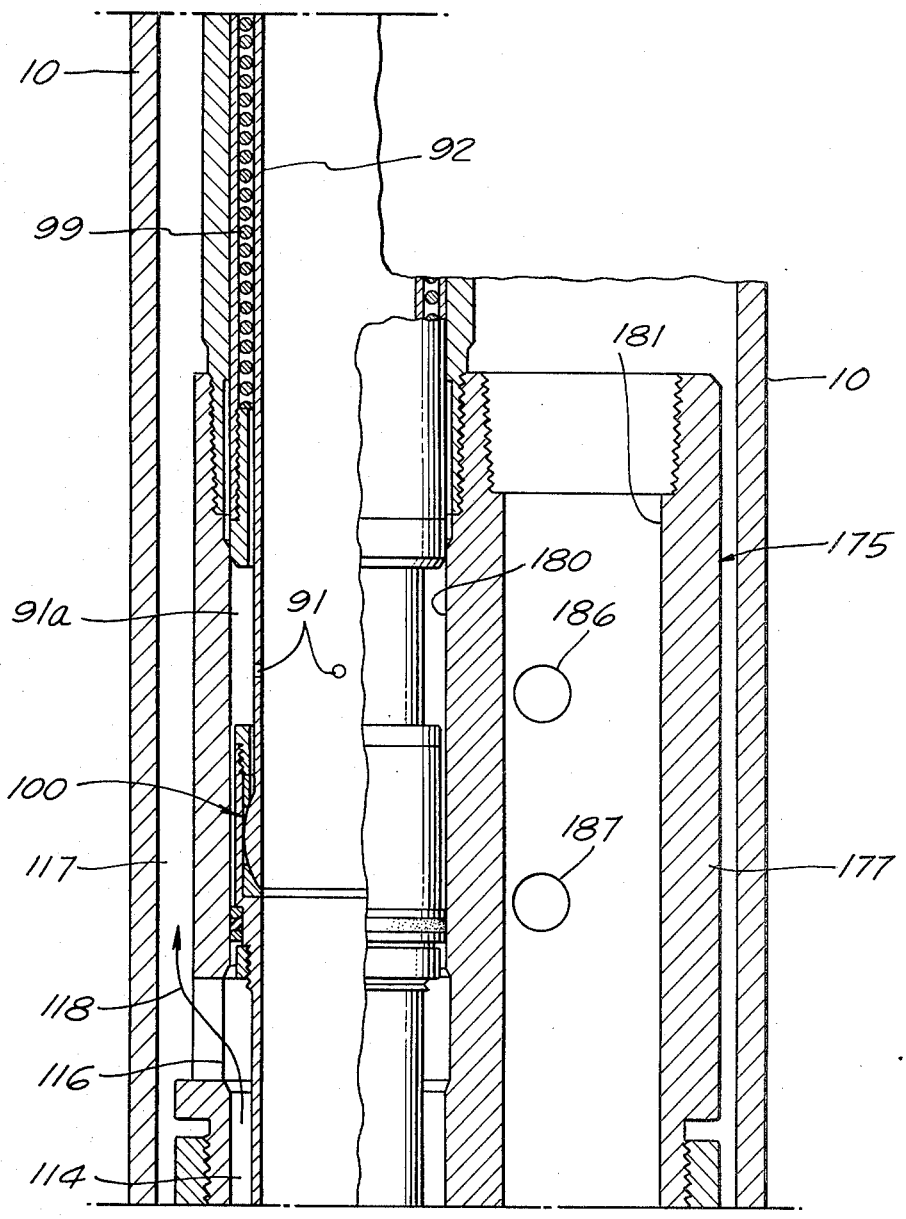
Figure 9C:
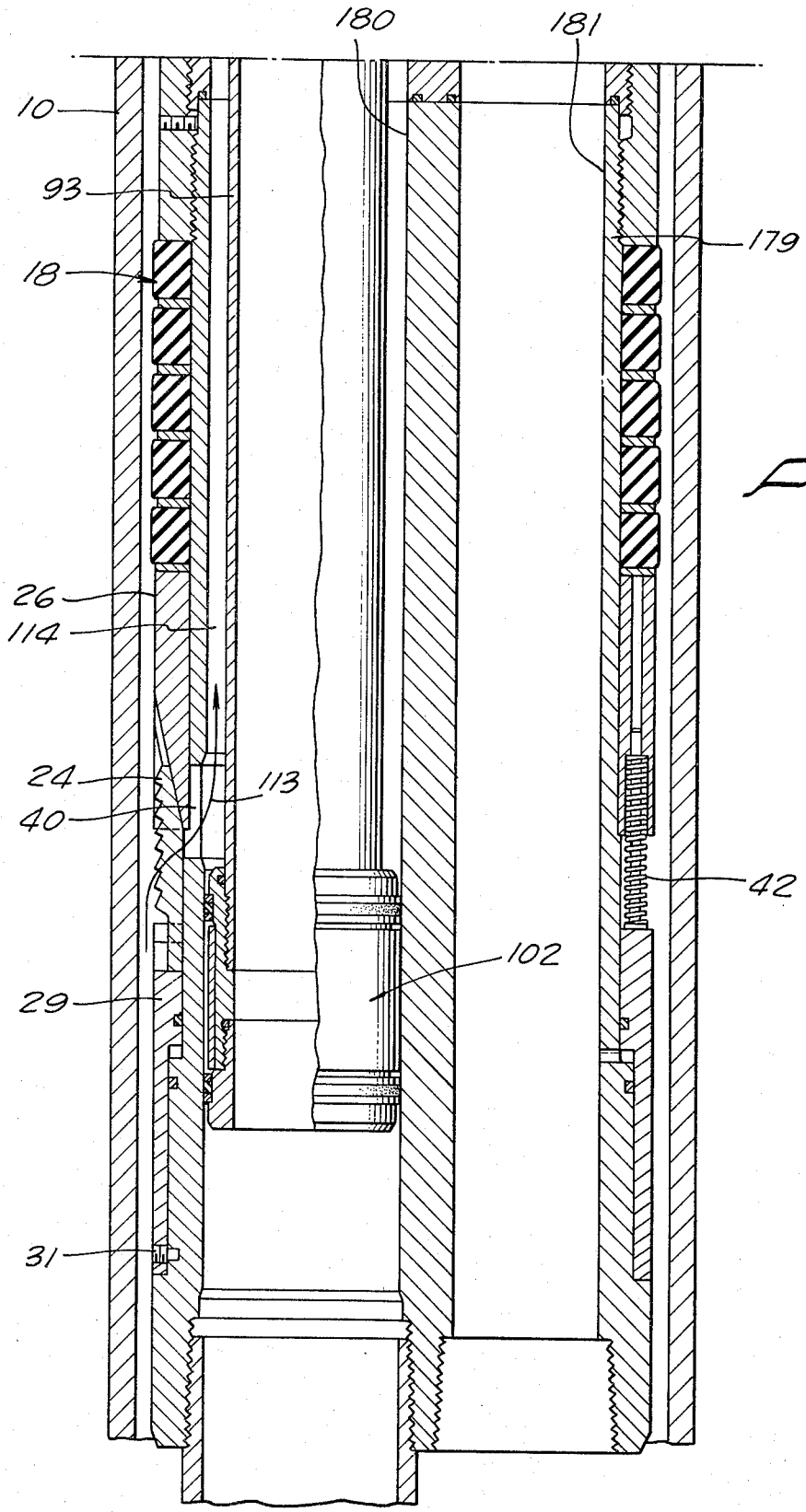

Referring finally to FIGS. 9, *9a–9c*, it will be seen that the same basic structure including the primary or casing annulus control valve is provided much in the same manner as in FIG. 7, et seq., and much in the same manner as exemplified by FIG. 5 of the first embodiment. FIG. 9, et seq., is then a simplified version in which the primary control valve which controls casing annulus flow is utilized but the tubing control valve is omitted by substituting the tubing string 200 in place and instead of the tubing string 48. Tubing string 200 includes only one control line connector block 201, control line 202 and accomodates only the primary control valve 60. With the exception of that variation of the basic concept of the present invention, the remainder of this version of the second embodiment incorporates all of the features of the embodiment shown in FIGS. 7, *7a–7c*.

By either of the versions shown in FIGS. 7 or 9, the operator is afforded the additional advantage of being able to control production flow from three different zones in an oil well. It will be seen that this is accomplished without major reduction in the cross-sectional areas used for production flow. The casing annulus which bypasses the packer is substantially the same in both embodiments and is controlled by a single annulus control valve operable from the surface of the well. Operation of the casing annulus control valve is not affected by nor does it in turn affect the flow of production in either of the two tubing strings. By utilizing the version shown in FIG. 7, the operator may, if he chooses to do so, add a tubing control valve to bore 181 and then he has the ability to independently control production flow in both of the tubing strings and in the casing annulus.

In addition to the foregoing options which the present invention provides for the operator of an oil well, including several variations in which control valves may be utilized in conjunction with the primary, casing annulus control valve, the flexible joint 100 situated between the two valve elements 92 and 93 allows misalignment of the bores which receive these respective elements without causing binding or resulting in a malfunction of the primary control valve. Additionally, the flexible joint 100 allows the lower seal element 102 to be separated from the rest of the valve for repair or replacement.

While particular embodiments of the present invention have been shown and described herein, it will be apparent to those skilled in the art that changes and modifications might be made therein without departing from the underlying concepts of the invention disclosed. It is the aim of the appended claims to cover all such changes and modifications as fall within the true scope and spirit of this invention.

We claim:

1. A flow control assembly for an oil well having two production zones, said well having a casing and a tubing string within said casing defining a casing annulus therebetween, and packing means for packing off between said tubing string and said casing to isolate said production zones, the improvement comprising:

a valve housing and a packer housing connected in series in said tubing string, said valve housing including a pair of fluid conducting control lines extending from the surface, said valve housing having a first landing means therein, said packer housing having packing means and lateral ports situated above and below said packing means;

a first valve removably positioned in said first valve housing landing means, said first valve including tubular means disposed adjacent said packing means, said tubular means forming a flow passage communicating the lateral ports above and below said packing means thereby bypassing said packing means, said tubular means having a piston structure for receiving fluid pressure from one of said control lines, said tubular means being thereby vertically reciprocal for selectively opening or closing said lateral ports to alter the flow of production fluid in the annulus, said first valve means further including second landing means therein;

a second valve removably positioned in said first valve and received therein in said second landing means, said second valve having a piston structure movable vertically within said first valve and having a piston surface for receiving fluid pressure from the second of said control lines for imparting vertical movement to said piston structure, said second valve means including a closure element actuated by said piston structure for altering the flow of production fluid within said tubing string.

2. A flow control assembly for an oil well having three production zones, said well having a casing and a pair of parallel tubing strings within said casing defining a casing annulus therebetween, and packing means for packing off between said tubing strings and said casing to isolate said production zones, the improvement comprising:

a packer housing connected in series in said tubing strings, said packer housing having packer means and lateral ports situated above and below said packing means, said packer housing having first and second tubing bores extending vertically therein;

a first valve housing coupled in series with said first tubing bore and a first tubing string, and a second valve housing coupled in series with said second tubing bore and a second tubing string, said first valve housing having a first landing means therein, said first valve housing further provided with a pair of fluid conducting control lines extending from the surface;

a first valve removably positioned in said first valve housing landing means, said first valve including tubular means disposed adjacent said packing means, said tubular means forming a flow passage communicating the lateral ports above and below said packing means thereby bypassing said packing means, said tubular means having a piston structure for receiving fluid pressure from one of said control lines, said tubular means being thereby vertically reciprocal for selectively opening or closing said lateral ports to alter the flow of production fluid in the annulus, said first valve means further including second landing means therein;

a second valve removably positioned in said first valve and received therein in said second landing means, said second valve having a piston structure movable vertically within said first valve and having a piston surface for receiving fluid pressure from the second of said control lines for imparting vertical movement to said piston structure, said second valve means including a closure element actuated by said piston structure for altering the flow of production fluid within said first tubing string;

a third valve removably positioned upon landing means in said second valve housing, said second valve housing having a third fluid conducting control line connected thereto and extending to the surface, said third valve having a piston structure movable vertically within said third housing and having a piston surface for receiving fluid pressure from the third control line for imparting vertical movement to said piston structure, said third valve further including a closure element actuated by said piston structure for altering the flow of production fluid within said second tubing string.

* * * * *